US009228480B2

(12) United States Patent
Wirkkala, II et al.

(10) Patent No.: US 9,228,480 B2
(45) Date of Patent: Jan. 5, 2016

(54) PISTON CROWN COOLING GALLERY INSERT

(71) Applicant: Mahle Industries, Incorporated

(72) Inventors: Kenneth L. Wirkkala, II, Warren, MI (US); Michael T. Lapp, Bloomfield, MI (US); Alex Antoc, Sterling Heights, MI (US)

( * ) Notice: Subject to any disclaimer, the term of this patent is extended or adjusted under 35 U.S.C. 154(b) by 0 days.

(21) Appl. No.: 14/298,186

(22) Filed: Jun. 6, 2014

(65) Prior Publication Data

US 2015/0354435 A1 Dec. 10, 2015

(51) Int. Cl.

| | |
|---|---|
| ***F01P 1/04*** | (2006.01) |
| ***F01P 3/10*** | (2006.01) |
| ***F02F 3/00*** | (2006.01) |
| *F02B 3/06* | (2006.01) |
| *F01P 3/08* | (2006.01) |
| *F02F 3/22* | (2006.01) |
| *F01M 1/08* | (2006.01) |

(52) U.S. Cl.

CPC ..... *F01P 3/10* (2013.01); *F02F 3/0015* (2013.01); *F01M 1/08* (2013.01); *F01P 3/08* (2013.01); *F02B 3/06* (2013.01); *F02F 3/22* (2013.01); *F05C 2201/021* (2013.01)

(58) Field of Classification Search

CPC ..... F01P 3/08; F02F 3/22; F01M 1/08; F02B 3/06; F05C 2201/021

USPC ..... 123/41.35

See application file for complete search history.

(56) References Cited

U.S. PATENT DOCUMENTS

| | | | | |
|---|---|---|---|---|
| 5,979,298 | A | 11/1999 | Whitacre | |
| 6,659,062 | B1 | 12/2003 | Issler | |
| 7,743,745 | B2 | 6/2010 | Scharp | |
| 8,047,123 | B2 | 11/2011 | Lahrman | |
| 8,347,842 | B2 | 1/2013 | Sadowski et al. | |
| 8,443,716 | B2 | 5/2013 | Keller | |
| 8,662,026 | B2 | 3/2014 | Azevedo et al. | |
| 2011/0114054 | A1* | 5/2011 | Miller et al. | 123/193.6 |
| 2013/0025550 | A1 | 1/2013 | Issler et al. | |

* cited by examiner

*Primary Examiner* — Lindsay Low
*Assistant Examiner* — Charles Brauch
(74) *Attorney, Agent, or Firm* — Reising Ethington P.C.

(57) ABSTRACT

An internal combustion engine piston includes a crown including a ring belt portion including an outer wall and ring grooves, wherein the outer wall has a first end, a combustion bowl including an inner wall having a second end, a top wall extending between the inner and outer walls, and an annular cavity between the inner and outer walls, including an opening opposite the top wall, and at least partially defining a cooling gallery. At least one insert protrudes into the cooling gallery so as to axially overlap the ring grooves to direct coolant to desired portions of the crown.

24 Claims, 4 Drawing Sheets

PISTON CROWN COOLING GALLERY INSERT

BACKGROUND

The present disclosure relates to pistons used in internal combustion engines fueled by gasoline, diesel, alcohol or any other combustible fuel. Internal combustion engine pistons are usually composed of two elements; a skirt and crown. While in service, pistons used in internal combustion engines, such as medium and heavy duty diesel engines, are exposed to extremely hot operating temperatures. To reduce the temperature of piston components, especially components adjacent to the combustion chamber, a cooling gallery may be provided within the piston crown. The cooling gallery may be formed by an interior volume located within the piston crown and may be covered with a piston crown cover plate. The cooling gallery is a permanent feature of the piston crown. A piston crown cover plate is typically located along a lower surface of the piston crown. The cooling gallery and crown cover plate generally define a chamber or channel having a permanently defined volume.

Due to severe thermal stresses generated by the hot combustion chamber temperatures, it may be necessary to cool the piston crown during engine operation. As one example, the piston crown for diesel engines may be cooled via an oil spray directed into the cooling gallery. The oil flows into the cooling gallery through an inlet aperture in the piston, and the reciprocating motion of the piston during engine operation generally moves the oil back and forth within the cooling gallery. Accordingly, at least part of the heat of the piston crown portion is removed. The heated oil typically exits the cooling gallery through an exit aperture in the piston, while fresh oil can be supplied to the cooling gallery through the inlet aperture.

Internal combustion engines, particularly medium and heavy duty diesel engines, include stringent cooling requirements due to the elevated combustion pressure and temperature within the combustion chamber. Moreover, to improve engine performance it has become increasingly desirable to operate engines at even higher combustion pressures and temperatures. Additionally, cooling requirements may vary depending on the intended operating conditions of a particular engine. Unfortunately, the existing cooling gallery formed in the piston crown may not always be able to meet the increasing cooling requirements or be fit for the intended cooling requirements of the piston crown in a particular engine.

Accordingly, there exists a need for a piston that will provide enhanced cooling properties when compared to the current pistons that are available today.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows.

DETAILED DESCRIPTION

Figure 1:
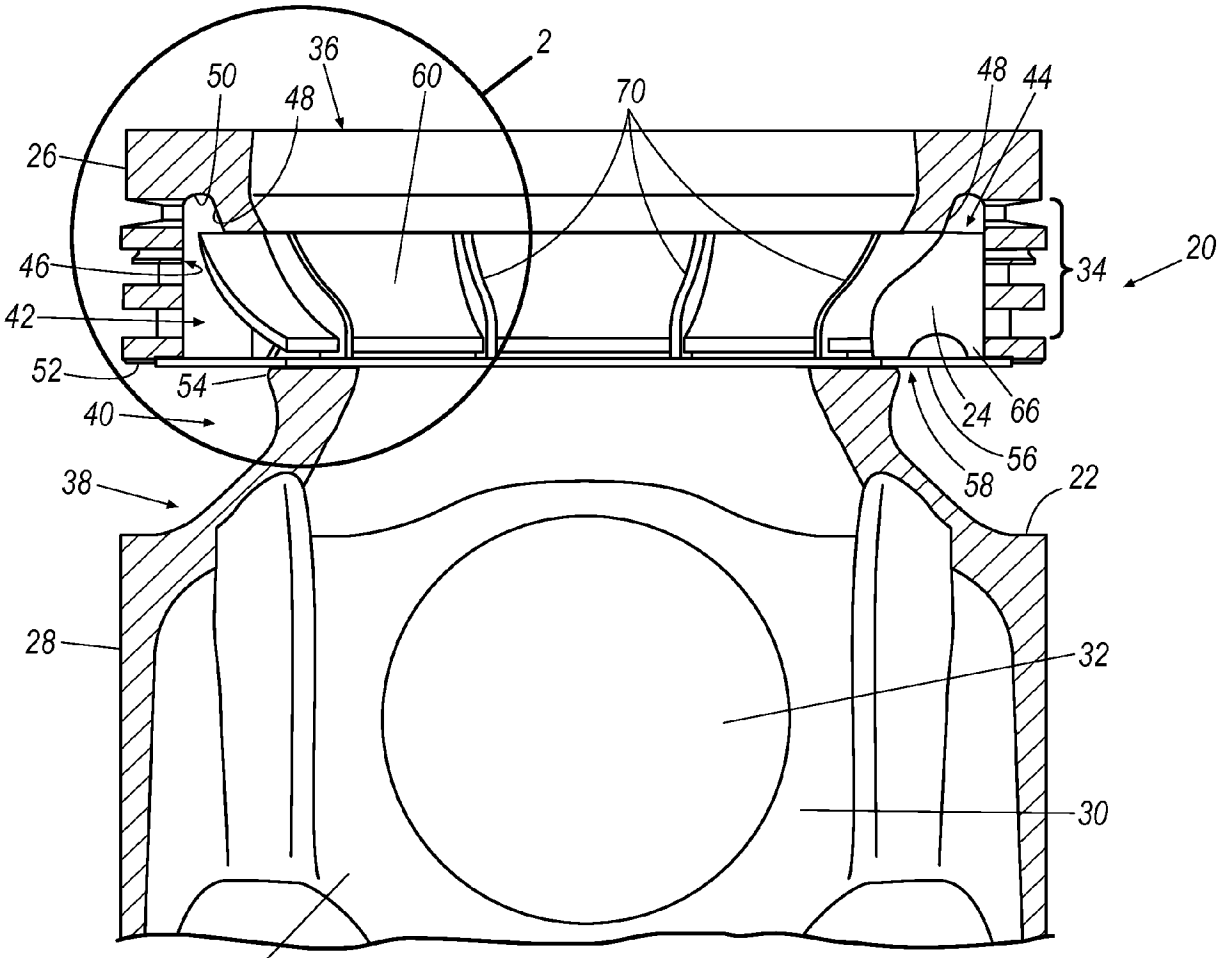
FIG. 1 is a cross sectional isometric view of a piston having an insert positioned in a cooling gallery of a piston crown according to one implementation.

The various features of the exemplary approaches illustrated and described with reference to any one of the figures may be combined with features illustrated in one or more other figures, as it will be understood that alternative illustrations that may not be explicitly illustrated or described may be able to be produced. The combinations of features illustrated provide representative approaches for typical applications. However, various combinations and modifications of the features consistent with the teachings of the present disclosure may be desired for particular applications or implementations. The representative illustrations below relate generally to a four-stroke, multi-cylinder, direct-injected, compression-ignition internal combustion engine. Artisans may recognize similar applications or implementations with other engine/vehicle technologies and configurations.

An exemplary piston assembly may include a piston crown and skirt. The crown may include a crown collar wall or ring belt extending axially downward towards the skirt. The crown may define at least in part a cooling gallery extending about the periphery of the crown adjacent to the ring belt. The cooling gallery may be machined or otherwise formed in the crown, and generally form a permanent feature in the piston crown. Accordingly, the cooling gallery defines a fixed volume for coolant to flow. However, as service requirements and parameters change depending on engine type or operating conditions, preexisting cooling galleries may not meet the cooling requirements required for optimum piston life and performance. The present disclosure provides a piston crown cooling system with enhanced and more efficient properties compared to current piston crown cooling system available today.

Positioning a pre-formed insert into the existing cooling gallery cavity allows the profile and/or shape of the cooling gallery to be altered without adding or removing additional material from the piston crown. Stated alternatively, while the cooling gallery may define a first fixed volume, arranging the insert in the cooling gallery defines a second volume included within the first volume. As operating parameters change or the engine type differs, the insert can be used to reconfigure an existing cooling gallery profile and/or shape to provide for optimum performance. For example, the insert may reduce the total volume of the cooling gallery thereby increasing the fill ratio of coolant in the cooling gallery. The reduced volume of the cooling gallery cavity allows coolant to circulate through the cooling gallery at a faster pace, and to be cooled more often, thus removing heat from the piston crown. Additionally, the insert may enhance the flow characteristics in the cooling gallery by providing for enhanced shaker-effect in response to the desired flow characteristics. Accordingly, the insert provides enhanced and more efficient properties compared to known piston crown cooling systems.

Additionally, different operating conditions and specifications for various engine types may require several different shapes or profiles of the cooling gallery using a basic piston crown design. However, the differences in shape or profile of a re-configured cooling gallery may add considerable cost to a piston configuration. The disclosed cooling gallery insert provides an alternative to change the shape or profile of the permanent cooling gallery without removing any material from the piston crown in order to achieve the desired results. Further, if the operating conditions for a given piston change or require modification, the insert may be removed and replaced in lieu of an insert configured to influence flow characteristics to optimize piston cooling of the particular piston. For example, the insert may couple to the piston via a secure snap fit connection, thereby allowing easy removal and replacement of the insert.

Referring to FIG. 1, an exemplary piston assembly 20 is provided having a piston 22 and an insert 24. The piston 22 may include a piston crown 26 and a piston skirt 28. The crown 26 and skirt 28 may be secured together in a manner that is convenient. The piston skirt 28 generally supports the crown 26 during engine operation, e.g., by interfacing with surfaces of an engine bore (not shown) to stabilize the piston assembly 20 during reciprocal motion within the bore. The skirt 28 may include piston pin bosses 30 extending axially downward relative to a longitudinal axis A from the skirt 28. The piston pin bosses 30 may be formed with an aperture 32 for receiving a piston pin (not shown). For instance, a piston pin may be inserted through the aperture 32 in the piston pin bosses 30, thereby generally securing the skirt 28 to a connecting rod (not shown). The pin bosses 30 may generally define an open area between the pin bosses, e.g., for receiving the connecting rod.

The piston crown 26 may include an annular ring belt portion 34 extending axially in the direction of the skirt 28. The ring belt portion 34 may include a plurality of ring grooves for receiving piston rings (not shown). The crown 26 may include a combustion bowl 36 on an upper surface of the crown 26. A panel area 38 may be located between the piston crown 26 and piston skirt 28 and define an annular recess 40. The annular recess 40 may be located between ring belt portion 34 and the skirt 28. The panel area 38 may include one or more apertures (not shown) for receiving fluid sprayed from a nozzle (not shown), e.g., engine oil. According to another variation, the crown 26 and skirt 28 may be secured via respective radially inner and outer mating surfaces (not shown) of the crown 26 abutting corresponding radially inner and outer mating surfaces (not shown) of the skirt 28.

The components of the piston crown 26 and piston skirt 28 may be formed from any materials that are convenient. In one example, the components of the crown 26 and skirt 28 may be formed of a same material, e.g., steel. In another example, the piston crown 26 may be formed of a different material than the piston skirt 28. As such, the material used for the crown 26 may include different mechanical properties, e.g., toughness, tensile strength, thermal elasticity, than the piston skirt 28. Any materials or combination may be employed for the crown 26 and skirt 28. Merely as examples, the crown 26 and/or skirt 28 may be formed of a steel material, cast iron, aluminum material, composite, or powdered metal. The crown 26 and skirt 28 may also be formed in different processes, e.g., the crown 26 may be a single cast piece, while the skirt 28 may be forged. Any material and/or forming combination may be employed that is convenient.

The piston 22, and more particularly the crown 26, may generally form a circumferentially extending annular cavity 42 defining at least part of a cooling gallery 44. The annular cavity 42 may be formed into the underside of the piston crown 26 adjacent to the ring belt portion 34. The annular cavity 42 together with a bottom portion may define the cooling gallery 44 which may generally facilitate cooling of the piston 22. The cooling gallery 44 may generally extend about a perimeter of the piston crown. As illustrated in FIG. 1, the cooling gallery 44 may be defined in part by the ring belt portion 34 and the combustion bowl 36. For example, the ring belt portion 34 may define an annular outer wall 46, the combustion bowl 36 may define a radially inner wall 48, and a top wall 50 may extend between the outer and inner wall 46, 48. The outer wall 46 may terminate at a first end 52, and the inner wall 48 may terminate at a second end 54. Additionally or alternatively, the outer wall 46 and/or inner wall 48 may further be defined by the piston skirt 28. As one example, the panel area 38 of the skirt 28 may define at least a portion of the inner wall 48 of the cooling gallery 44, e.g., such that the inner wall 48 is comprised of the combustion bowl 36 and skirt 28. As another example, the cooling gallery 44 may be defined by respective radially inner and outer mating surfaces (not shown) of the crown 26 and skirt 28. For instance, the radially outer mating surfaces of the crown 26 and skirt 28 may define the outer wall 46 and the radially inner mating surfaces of the crown 26 and skirt 28 may define the inner wall 48.

The first and second ends 52, 54 of the outer and inner walls 52, 54 may be configured to secure the insert 24 and/or cover plate 56 to the piston crown 26, as will be described in more detail below. For instance, the first and/or second end 52, 54 may include a radial step or shelf for supporting a complementary edge of the insert 24 and/or cover plate 56. Additionally or alternatively, the ends 52, 54 may include a notch or collar for insertably receiving an edge of the insert 24 and/or cover plate 56. As a further example, the ends 52, 54 may include bores aligning with corresponding bores on the insert 24 and/or cover plate 56 for receiving fasteners. Moreover, the first and second ends 52, 54 may prevent circumferential rotation of the insert 24 and/or cover plate 56 during reciprocating motion of the piston 22.

The cooling gallery 44 may include an interior volume V located within the piston crown 26. The cooling gallery 44 is in fluid communication with one or more nozzles (not shown) for directing fluid, e.g., engine oil, into the piston crown 26. This fluid will cool the inside walls 46, 48, 50 of the cooling gallery 44 as a result of the rapid reciprocating motion typical of pistons for internal combustion engines during operation. The fluid that is introduced into the cooling gallery 44 may be permitted to escape through the aperture 32 for drainage backing into the crank case of the engine (not shown). The fluid may also be able to drain towards the skirt 28 around the outer surfaces or perimeter of the piston 22, at least to the extent allowed by the insert 24 and/or cover plate 56.

The annular recess 40 may be formed by the panel area 38 and may generally be located between the ring belt 34 and the skirt 28. The cooling gallery 44 may be in fluid communication with the annular recess 40 via the cover plate apertures 58. As such, the annular recess 40 and cooling gallery 44 may both accumulate fluid during operation of the piston 22 within the internal combustion engine. Therefore, both the cooling gallery 44 and annular recess 40 may include fluid that cools the piston.

According to one implementation, the piston 22 may include a bottom cover plate 56 enclosing the annular cavity 42 within the piston crown 26 thereby defining the cooling gallery 44. The cover plate 56 may be secured to the first and second ends 52, 54 of the outer and inner wall 46, 48, respectively. The cover plate 56 may be generally be accessible after assembly of the crown 26 and skirt 28 to allow insertion, assembly and/or removal of the cover plate 56 from the piston 22.

The cover plate 56 may form a lower boundary of the cooling gallery 44, thereby enclosing the cooling gallery 44 within the crown 26, and preventing coolant from freely entering and escaping the cooling gallery 44. At the same time, one or more inlets (not shown) and/or outlets (not shown) may be provided to allow fluid or other coolants to be circulated throughout the coolant gallery 44 to/from the engine (not shown) in a controlled manner, thereby reducing and/or stabilizing operating temperatures associated with the piston assembly 20 and components thereof. As such, the ring belt 34, combustion bowl 36 and cover plate 56 may delimit a cooling gallery 44 with a fixed volume $V_1$.

Figure 2:
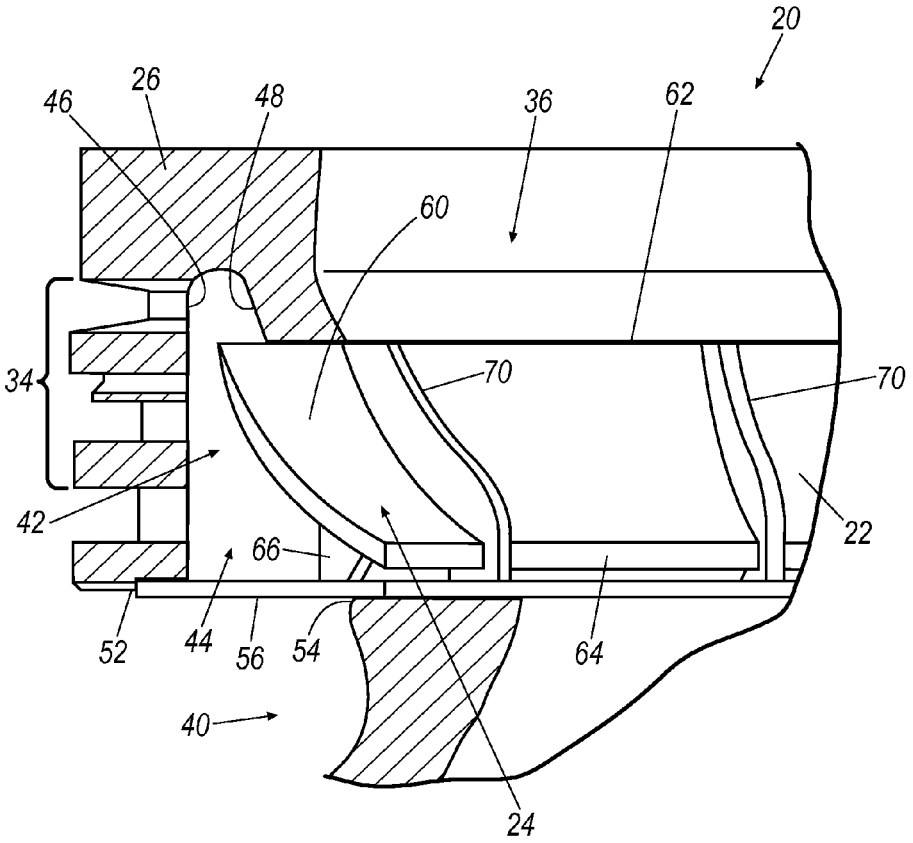
FIG. 2 is a partial cross sectional isometric view of the piston and insert illustrated in FIG. 1.

As illustrated in FIGS. 1 and 2, at least one annular insert 24 may be positioned into the existing cooling gallery 44 and circumferentially extend at least partially along the annular cavity 42. The insert 24 may axially protrude beyond the first and second ends 52, 54 into the cooling gallery 44, altering the fixed volume $V_1$ without adding or removing additional material from the underside of the piston crown 26. That is, the insert 24 may occupy at least part of cooling gallery 44 thereby establishing a reduced volume $V_2$ defined in the cooling gallery 44. Accordingly, the insert 24 may operate to displace the fluid, e.g., oil or other coolant, flowing in the cooling gallery 44. By reducing the fixed volume $V_1$ of the cooling gallery 44 to reduced volume $V_2$, the insert 24 may enhance the cooling efficiency of the cooling gallery 44 by increasing the fill ratio of coolant. For instance, the insert 24 may increase the fill ratio of coolant in the cooling gallery 44 to approximately fifty (50) to ninety (90) percent coolant to air. Moreover, the insert 24 may influence the flow rate of coolant within the cooling gallery 44, as a higher ratio of coolant to air is contained in a cooling gallery 44 with reduced volume $V_2$. That is, the same amount of fluid may be introduced into the cooling gallery 44 having a reduced volume $V_2$, which may result in a faster fluid flow rate. As such, the insert 24 may increase the flow rate of coolant circulating throughout the cooling gallery 24.

The insert 24 may include a profile generally conforming to the surface profile of the cooling cavity 42 (e.g., outer and inner wall 46, 48). The insert 24 may include an annular body 60 extending the radial length of the cooling gallery 44 cross section. The insert body 60 may include at least one radially outer portion 62 cooperating with the outer wall 46, and at least one radially inner portion 64 cooperating with the inner wall 48. The body 60 may extend transversely from the outer wall 46 to the inner wall 48 of the cooling gallery 44. According to one example, the body 60 may include a radial gradient or declivity extending from the outer wall 46 to inner wall 48. For instance, the outer portion 62 may include a greater axial extent than the inner portion 64, or vice versa. Similarly, the outer portion 62 may be positioned offset from the inner portion 64, e.g., such that the body 60 extends diagonally through the radial cross section of the cooling gallery 44 relative to the longitudinal axis A. The sloped profile of the insert body 60 may facilitate coolant flow and/or increase the flow rate of coolant circulation. Moreover, the sloped profile may direct coolant to desired zones of the piston crown 26, e.g., zones experiencing greater or lesser operating temperatures. The body 60 may further include a profile having sloped and level sections. According to one variation, the body 60 may include an actuate profile, for instance a concave design as shown in FIGS. 1 and 2. According to other variations, the body 60 may include a convex, bowl shape, linear or other suitable design.

According to one example, the insert 24 may be mounted on the cover plate 56. The cover plate 56 may form the bottom periphery of the cooling gallery 44, and the insert may be configured to guide the fluid through the cooling gallery 44. The cover plate 56 may be configured to secure the insert 24 in position, and thereby prevent circumferential rotation. The insert 24 may include a mating surface 66, for example a support or base, to securely mount the insert 24 to the cove plate 56. The insert 24 may be securely attachable and removable from the cover plate 56, for example to replace or reconfigure the insert 24. Pursuant to another variation, the insert 24 may be integral with the cover plate 56, e.g., via a forging or casting process.

Figure 3:
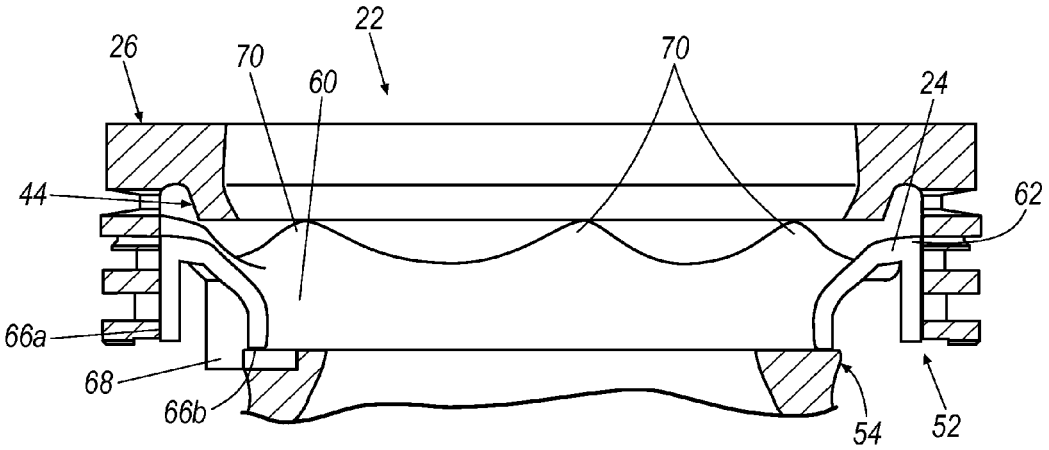
FIG. 3 is a partial cross sectional isometric view of an insert positioned in a cooling gallery of a piston crown according to another implementation.

According to another example illustrated in FIG. 3, the insert 24 may enclose the bottom of the cooling gallery 44, and accordingly a cover plate 56 may be excluded. The insert 24 may include a mating surface 66, e.g., a first mating surface 66A and a second mating surface 66B, complementary to the first and second ends 52 54, respectively. For instance, the insert mating surfaces 66A, 66B may comprise the male portion and the first and second ends 52, 54 may comprise the female portion, or any combination thereof. As one example, the insert 24 (e.g., mating surfaces 66A, 66B) may include a flange (not show) that engages a corresponding ledge (not shown) of the first and second ends 52, 54. The insert 24 may be configured to be fastened to the piston crown 26 (e.g., via bores and securing pins), and/or may be configured to be secured via a snap fit connection. Pursuant to one variation, the insert 24 may be securely connectable to the piston crown 26 such that the insert 24 may be freely assessable and removed for reconfiguration and/or replacement.

Figure 4:
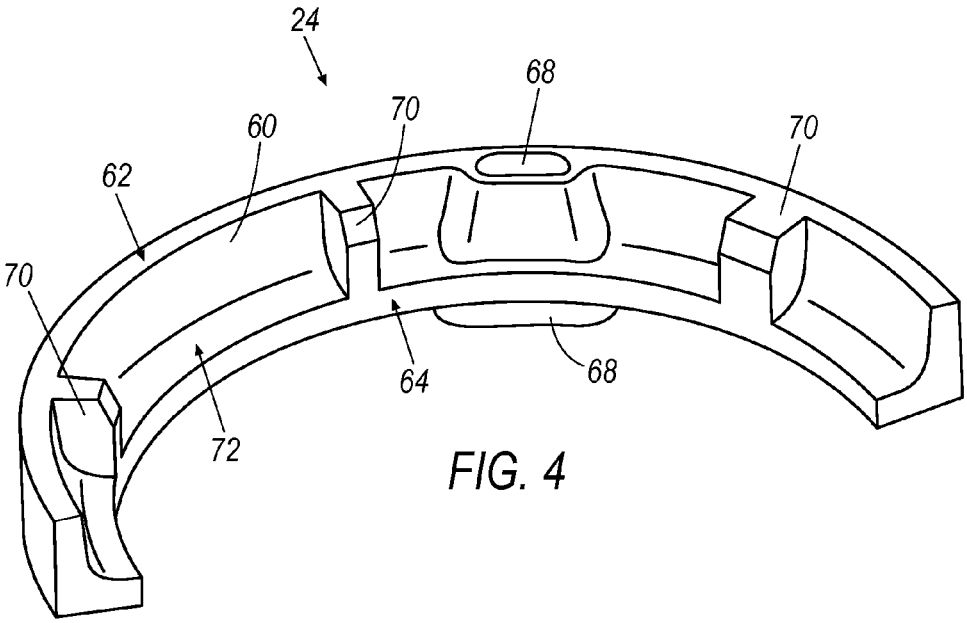
FIG. 4 is an isometric view of an insert according to a further implementation.

FIG. 4 illustrates one variation of an exemplary insert 24. The insert 24 may include a body 60, at least one aperture 68, and at least one insert element 70. The insert 24 may extend at least partially about the periphery of the cooling gallery 44. According to one implementation, the insert 24 extends the entire periphery of the cooling gallery 44. Pursuant to another implementation, a plurality of cooling inserts 24 may be positioned in tandem to extend at least partially about the periphery of the cooling gallery 44. For instance, the cooling inserts 24 may be separated circumferentially via a recess or gap (not shown) disposed between two adjacent inserts 24.

The insert 24 may be formed of a resilient and heat resistant material. For instance, the insert 24 may include metal, such as a steel material, iron, aluminum material, composite, or powdered metal. Additionally or alternatively, the insert 24 may include a heat resistant polymer, such as synthetic or semi-synthetic plastics. The insert 24 may be formed via a variety of processes, including but not limited to casting, molding, injection molding, forging, stamping, pressing, machining, etc. The insert 24 may likewise be formed via a combination of processes. For instance, an initial insert 24 block may be forged or cast, and a machining operation may be employed to remove material to form the aperture(s) 68 and/or insert element(s) 70. The insert 24 may be configured to conform to the profile of the annular cavity 42 or cooling gallery 44. The insert body 60 may include a cross section based at least in part on the desired flow characteristics of the coolant in the cooling gallery 44. For instance, if greater displacement of coolant is desired, a body 60 with a greater cross sectional area may be selected. The body 60 may include a radially outer and inner portion 62, 64 defining an actuate profile in communication with the fluid of the cooling gallery 44. The combination of the body 60 cross section and profile may act in conjunction to influence change in volume of the cooling gallery 44 as well as the flow rate of circulating coolant. According to one variation, the outer portion 62 may include a greater axial extent than the inner portion 64, further influencing the flow of the coolant within the cooling gallery 44.

The insert 24 may include at least one aperture 68 for discharging and/or receiving coolant. For instance, one or more apertures 68 may allow coolant to be sprayed into the cooling gallery 44 via a pump and spray nozzle (not shown), and one or more apertures 68 may fluidly connect the cooling gallery 44 to the annular recess 40. If the piston 22 includes a cover plate 56, the aperture(s) 68 may be aligned with the corresponding aperture(s) 58 of the cover plate 56. In this example, the insert aperture(s) 68 may likewise function as a positioning device for the insert elements 70, as the insert aperture(s) 68 may be aligned with the cover plate aperture(s) 56. That is, the element(s) 70 may be arranged at predetermined positions on the insert 24 relative to the aperture(s) 68 to ensure proper placement of the element(s) 70 in the cooling gallery 44.

Figure 5:
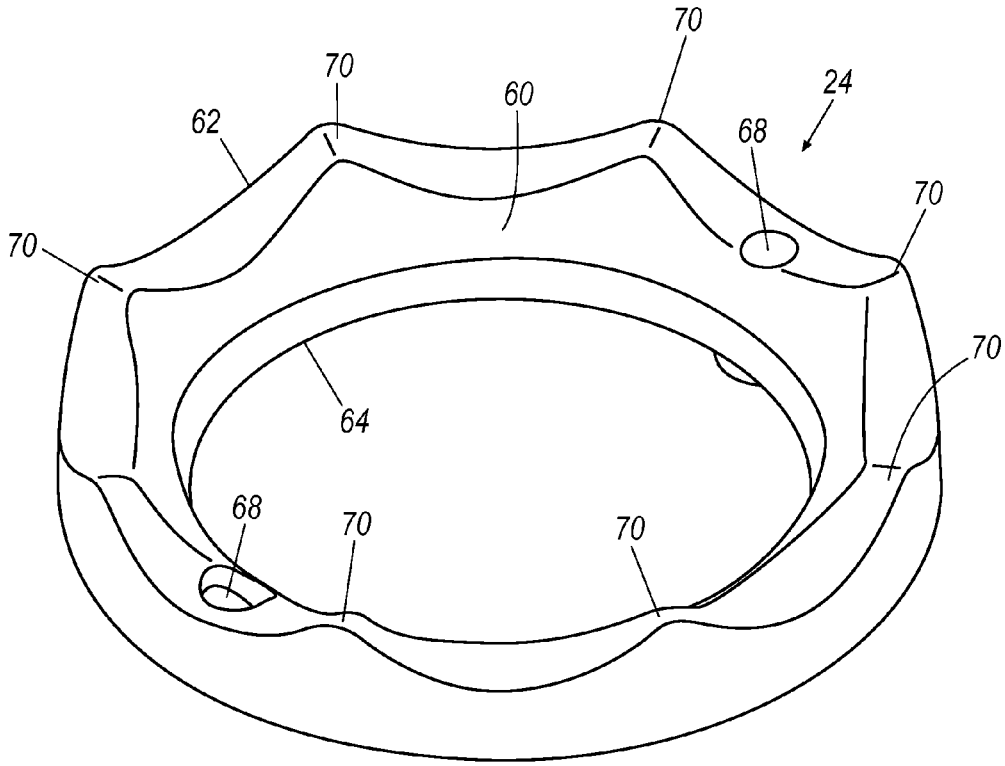
FIG. 5 is an isometric view of an insert according to another variation.

The aperture 68 may include a diameter or cross section sized to control the discharge of coolant from the cooling gallery 44. That is, the aperture 68 diameter or cross section may be sized at least partially in response to measured or estimated operating parameters of the piston 22. For instance, a piston 22 requiring a cooling gallery 44 with a higher coolant fill ratio may include an aperture with a smaller cross section to reduce the rate at which coolant drains from the cooling gallery 44. As such, the diameter or cross section of the aperture 68 may assist in influencing the flow characteristics of the coolant in combination. Additionally or alternatively, the aperture 68 may be incorporated into an element 70, and thus be configured to influence coolant circulation in the same manner as the element(s) 70 as well as operate as a fluid passage for the cooling gallery 44, as shown in FIG. 4. According to another variation as illustrated in FIG. 5, the aperture 68 may be depressed in the insert body 60 and accordingly may have less influence on the flow characteristics of coolant circulating in the cooling gallery.

The insert 24 may include one or more raised or depressed insert elements 70 or features circumferentially arranged about the insert body 60 in communication with the cooling gallery 44. The elements 70 may include varying cross sections, axial extent, radial extent, and/or circumferential extent, for example. The element(s) 70 may be configured to project into the cooling gallery 44 orthogonally, axially, radially, or a combination thereof. According to one example, the element(s) 70 may extend radially from the outer wall 46 to the inner wall 48 and generally conform to the profile of the inner wall 48. The element(s) 70 may be integral with, or separate from, the body 60. The element(s) 70 may be operable to influence and/or direct the coolant flow to desired "hotspots" in the cooling gallery 44, e.g., a region of the crown 26 experiencing a greater thermal temperature than another region such as adjacent the combustion bowl 36. Additionally or alternatively, the element(s) 70 may be operable to extend the dwell time of the coolant in the cooling gallery 44 and thereby achieve superior heat dissipation from zones of the piston 22 to be cooled.

The dimensions or cross section of the element(s) 70, e.g., annular, axial and/or radial extent, may be determined at least in part on desired flow characteristics for the piston 22. For instance, an element 70 with a large circumferential extent may facilitate greater laminar flow of coolant compared to an element 70 with a small circumferential extent but large axial extent. Likewise, the dimensions or cross section of the element 70 may influence the fill ratio of the cooling gallery 44, as an element with a large cross section may displace more volume available in the cooling gallery 44.

The elements 70 may be strategically distributed about the periphery of the insert 24 to create zones of laminar and/or turbulent coolant flow. The elements 70 may be disposed symmetrically or asymmetrically on the insert 24 along the periphery of the cooling gallery 44 to achieve desired flow characteristics. For example, an asymmetric arrangement of the elements 70 may include one or more elements 70 to have a closer circumferential distance relative to a first adjacent element 70 than a second adjacent element 70 opposite the first, e.g., such that the elements 70 enclose different circumferential angles with each other.

According to one example, the elements 70 may be configured to increase the rate of circulation, e.g., flow rate, of the coolant in certain portions of the cooling gallery 44 that do not require extended dwell time or contact with the coolant. That is, the dimensions or cross section of the elements 70 may be varied to create zones of laminar or turbulent coolant flow. For instance, an element 70 with a greater axial extent or protrusion into the cooling gallery 44 may interrupt fluid flow as compared to an element 70 with a smaller axial extent. Additionally or alternatively, the elements 70 may be configured to define a shaker chamber 72 in order to extend the dwell time of the coolant in the cooling gallery 44. For instance, referring to FIGS. 1 and 4, two adjacent annular spaced elements 70 may project radially from the outer portion 62 of the body 60 to the inner portion 64 and therefore abut the inner wall 70 of the gallery 44, defining a shaker chamber 72 there between. The shaker chamber 72 may be positioned in the region of a hotspot. Once coolant flow circulates into the shaker chamber 72, the elements 70 may interrupt the annular circulation of the coolant and consequently extend the dwell time of the coolant in that region. According, the coolant in the shaker chamber 72 is brought into contact with the hotspots to be cooled multiple times in a shaker-like manner by the insert elements 70 together with the reciprocating motion of the piston 22.

FIG. 5 illustrates an exemplary insert 24 including raised elements 70 according to another implementation. The elements 70 may extend axially from the outer portion 62 of the insert body 60 to create a series of ridges or peaks extending about the periphery of the cooling gallery 44. The elements 70 may influence areas of laminar and turbulent fluid flow, and may further reduce the volume of the cooling gallery 44. Accordingly, the coolant may circulate at a faster rate, cooling the outer and inner walls 46, 48 more often and thus removing more heat from the piston crown 26. Moreover, the element 70 peaks may be disposed at regions experiencing low operating temperatures to facilitate flow of coolant towards regions of the crown 26 experiencing high temperatures, for example.

Figure 6:
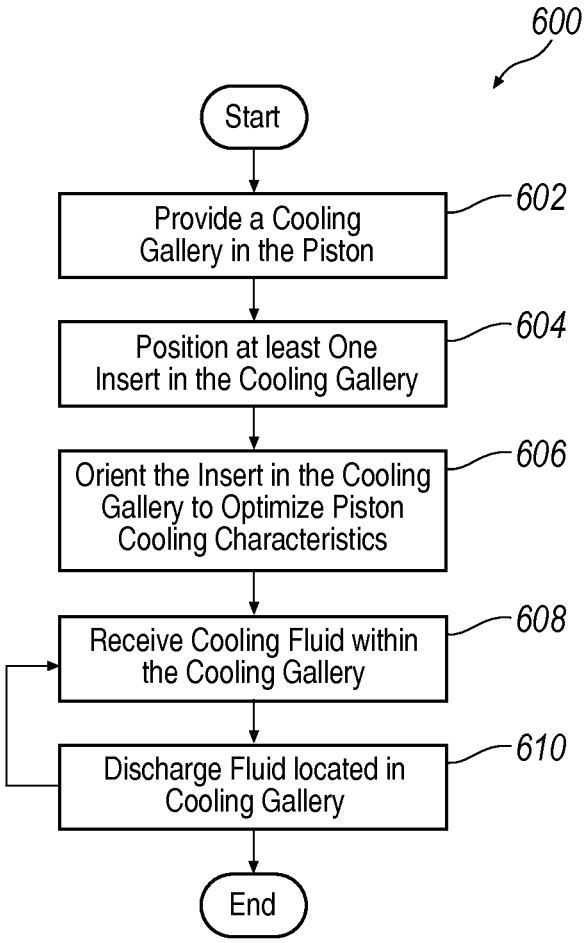
FIG. 6 is a flow chart illustrating a process for cooling the piston of FIG. 1.

Turning now to FIG. 6, a process 600 for cooling a piston is illustrated. Process 600 may begin with step 602, which is providing a cooling gallery in an upper portion of a piston or a piston crown. For example, as described above, a piston crown 26 may include a cooling gallery 44 radially adjacent to a ring belt 34. The cooling gallery 44 may define a fixed volume $V_1$. The process 600 may then proceed to step 604.

In step 604, at least one insert is positioned in the cooling gallery. For example, an insert 24 may be mounted on a cover plate 56 and project into the cooling gallery 44. Alternatively, the cover plate 56 may be excluded and the insert 24 may enclose and/or substantial seal the cooling gallery 44. The insert 24 may define a new base of the cooling gallery 44, thereby establishing a reduced cooling gallery volume $V_2$ without altering the surfaces of the cooling gallery 44. The cross sectional size of the insert 24 may be based at least in part on the engine type, operating conditions, and desired fill ratio of the cooling gallery 44. That is, an insert 24 with a large cross section may achieve a greater fill ratio of coolant to gas as compared to an insert 24 with a smaller cross section. The insert 24 may include at least one aperture 68 and at least one element 70. The aperture(s) 68 may include dimension, e.g., diameter, cross section, tapered nozzle, etc., to control the discharge of fluid from the cooling gallery 44. Additionally or alternatively, the element(s) 70 may include dimensions, e.g., circumferential extent, axial extent, radial extent, selected at least partially in response to the estimated operating parameters, engine type, fill ratio and/or flow characteristics. For instance, the dimensions of the element(s) 70 may vary depending on whether it is desired to have laminar or turbulent fluid flow, prolonged dwell time of fluid, and/or a fast flow rate. The process 600 may proceed to step 606.

In step 606, the insert may be oriented or aligned within the cooling gallery to optimize piston cooling characteristics. For instance, the elements 70 may be distributed along the periphery of the insert 24 at determined hotspots or regions of the piston crown 26 which experience greater temperatures during engine operation. The elements 70 may be configured to define shaker chambers 72 in order to extend the dwell time of coolant in the cooling gallery 44 thus removing more heat from the piston crown 26. Additionally or alternatively, the element(s) 70 may define a zone of laminar flow and/or a faster paced flow rate at various regions of the cooling gallery 44. The insert aperture(s) 68 may assist in aligning the insert 24 within the cooling gallery 44 in response to the relationship between the aperture(s) 68 and the element(s) 70. That is, the element(s) 70 may be arranged along the insert 24 based on the circumferential distance of the element(s) 70 relative to the aperture(s) 68. Additionally or alternatively, the insert mating surfaces 66 may likewise facilitate alignment of the insert 24 in the cooling gallery 44, e.g., via aligning fixing bores, male and female mating connections, etc. Once alignment is achieved, the insert 24 may be secured in position (e.g., via the insert 24 itself and/or via the cover plate 56). Then the process 600 may proceed to step 608.

In step 608, fluid such as oil or other coolant may be received within the cooling gallery. For example, engine oil may be received within the cooling gallery 44 through a spray nozzle inlet (not show) as described above. The fluid may be circulated peripherally in the cooling gallery 44. The fluid flow may be influenced by the insert 24 cross section, aperture(s) 68 and/or element(s) 70. As an example, the insert 24 may establish a reduced volume $V_2$ in the cooling gallery 44, thereby increasing the fill ratio of fluid to air. Resultantly, the flow rate may likewise be increased because a fixed amount of fluid is circulating through the cooling gallery 44 with a reduced volume $V_2$. Moreover, the fluid flow may be influenced by designated laminar flow or turbulence zones defined by the insert elements 70. Additionally or alternatively, the fluid circulation may be interrupted by established shaker chambers 72 configured to extend the dwell time of fluid in regions of elevated operating temperatures to enhance the cooling effect of the fluid. The process 600 may then proceed to step 610.

In step 610, the fluid located in the cooling gallery may be discharged via one or more apertures in the insert. For example, fluid communicated to aperture (s) 68 may drain from the cooling gallery 44 into the panel area 38 or skirt 28 and into the engine cylinder (not shown). As described above, the rate of discharge may be influenced by the dimensions of the aperture(s) 68. Pursuant to a variation of a piston 22 having a cover plate 56, the insert aperture(s) 68 may be fluidly connected to the cover plate aperture(s) 58 and drain into the engine cylinder. The process 600 may loop back to step 608 for continued circulation of fluid in the cooling gallery 44 during engine operation. Accordingly, fresh cool fluid is received in the cooling gallery 44, and exhausted heated fluid is discharged into the engine cylinder. The process 600 may cycle between steps 608 and 610 until engine operation ceases. Then the process 600 ends.

Accordingly, while illustrative implementations of the present disclosure have been shown and described, it is obvious that changes and modifications may be made thereunto without departing from the spirit and scope of the disclosure. For example, while the insert 24 is illustrated as having a greater axial extent on the outer wall 46 of the cooling gallery 44 (e.g., the outer portion 62 includes a greater axial extent than the inner portion 64), this disclosure contemplates such configuration may be reversed such that the insert 24 includes a greater axial extent on the inner wall 48 relative to the outer wall 46 of the cooling gallery 44.

With regard to the processes, systems, methods, etc. described herein, e.g., process 600, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many implementations and applications other than the examples provided would be apparent upon reading the above description. It is anticipated and intended that future developments will occur in the arts discussed herein, and that the disclosed systems and methods will be incorporated into such future implementations. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed as new and desired to be protected by Letters Patent of the United States is:

1. An internal combustion engine piston, comprising:

a crown including:

a ring belt portion including an outer wall and ring grooves, wherein the outer wall has a first end, a combustion bowl including an inner wall having a second end, a top wall extending between the inner and outer walls, and an annular cavity between the inner and outer walls, including an opening opposite the top wall, and at least partially defining a cooling gallery; and at least one insert protruding into the cooling gallery so as to axially overlap the ring grooves to direct coolant to desired portions of the crown.

2. The piston of claim 1, further comprising:
a cover plate covering the opening of the cooling gallery, wherein the at least one insert protrudes away from the cover plate and into the cooling gallery.

3. The piston of claim 1, including no cover plate separate from the at least one insert.

4. The piston of claim 1, wherein the cover plate and the at least one insert are separate components.

5. The piston of claim 1, wherein the cover plate and the at least one insert are an integral component.

6. The piston of claim 1, wherein the at least one insert includes a radially inner portion, and a radially outer portion having a greater axial extent than the radially inner portion.

7. The piston of claim 1, wherein the at least one insert includes a plurality of elements circumferentially spaced about the body in communication with the cooling gallery and defining at least one chamber to interrupt annular circulation of coolant.

8. The piston of claim 1, wherein the at least one insert includes an annular body including a radially outer portion and a radially inner portion, and wherein the at least one insert includes a plurality of elements extending axially from the radially outer portion and circumferentially spaced about the body in communication with the cooling gallery and defining at least one chamber to interrupt annular circulation of coolant.

9. The piston of claim 1, wherein the at least one insert defines a concave profile.

10. The piston of claim 1, wherein the at least one insert includes at least first and second elements circumferentially spaced about the body in communication with the cooling gallery and defining at least one chamber therebetween to interrupt annular circulation of coolant, wherein the first element has a first circumferential extent and the second element has a second circumferential extent less than the first circumferential extent of the first element.

11. The piston of claim 1, wherein the at least one insert includes at least first and second elements circumferentially spaced about the body in communication with the cooling gallery and defining at least one chamber therebetween to interrupt annular circulation of coolant, wherein the first element has a first axial extent and the second element has a second axial extent, wherein the first axial extent is greater than the second axial extent.

12. The piston of claim 1, further comprising a skirt depending from the crown, wherein the at least one insert includes at least one aperture fluidly connecting the cooling gallery to an outer surface of the skirt.

13. The piston of claim 1, wherein the cooling gallery defines a first volume, and the at least one insert occupies the first volume so as to define a second volume smaller than the first volume.

14. An internal combustion engine piston, comprising:
a crown including:
a ring belt portion including an outer wall and ring grooves, wherein the outer wall has a first end,
a combustion bowl including an inner wall having a second end,
a top wall extending between the inner and outer walls, and
an annular cavity between the inner and outer walls, including an opening opposite the top wall;
a bottom cover secured to the first and second ends of the outer and inner walls and cooperating with the annular cavity to establish a cooling gallery; and
at least one insert protruding into the cooling gallery so as to axially overlap the ring grooves to direct coolant to desired portions of the crown.

15. The piston of claim 14, wherein the bottom cover includes a cover plate separate from the at least one insert.

16. The piston of claim 14, wherein the bottom cover and the at least one insert are an integral component.

17. The piston of claim 14, wherein the at least one insert includes a radially inner portion, and a radially outer portion having a greater axial extent than the radially inner portion.

18. The piston of claim 14, wherein the at least one insert includes a plurality of elements circumferentially spaced about the body in communication with the cooling gallery and defining at least one chamber to interrupt annular circulation of coolant.

19. The piston of claim 14, wherein the at least one insert includes an annular body including a radially outer portion and a radially inner portion, and wherein the at least one insert includes a plurality of elements extending axially from the radially outer portion and circumferentially spaced about the body in communication with the cooling gallery and defining at least one chamber to interrupt annular circulation of coolant.

20. A piston for internal combustion engines, comprising:
a crown including:
a ring belt portion having an inner wall;
a combustion bowl having an outer wall and an upper wall;
an annular cooling gallery disposed between the outer and upper walls of the combustion bowl and the inner wall of the ring belt;
a cover plate; and
at least one insert in the cooling gallery between the cover plate and the combustion bowl.

21. The piston of claim 20, wherein the cover plate is positioned in an opening at a bottom of the cooling gallery.

22. The piston of claim 20, wherein the at least one insert and the cover plate are separate components.

23. The piston of claim 20, wherein an outer wall of the insert is in annular proximity to the inner wall of the ring belt.

24. The piston of claim 23, further comprising a volume between an outer surface of the at least one insert and the inner wall of the ring belt, and another volume between an inner surface of the at least one insert and the outer wall of the combustion bowl.

* * * * *